US008309184B2

(12) United States Patent
Penttinen et al.

(10) Patent No.: US 8,309,184 B2
(45) Date of Patent: Nov. 13, 2012

(54) PRIMING AND COATING PROCESS

(75) Inventors: Tapani Penttinen, Huutjärvi (FI); Kimmo Nevalainen, Karhula (FI); Isto Heiskanen, Imatra (FI); Kaj Backfolk, Imatra (FI); Minna Peltola, Tampere (FI); Ali Harlin, Vantaa (FI)

(73) Assignee: Stora Enso Oyj, Helsinki, FL (US)

( * ) Notice: Subject to any disclaimer, the term of this patent is extended or adjusted under 35 U.S.C. 154(b) by 720 days.

(21) Appl. No.: 11/152,656

(22) Filed: Jun. 14, 2005

(65) Prior Publication Data

US 2006/0193994 A1 Aug. 31, 2006

(30) Foreign Application Priority Data

Feb. 25, 2005 (FI) ..... 20050225

(51) Int. Cl.
*B05D 1/04* (2006.01)

(52) U.S. Cl. ..... 427/458; 427/472; 427/562; 118/72; 118/629; 118/630; 118/638; 239/695; 239/696; 239/706; 239/708

(58) Field of Classification Search ..... 427/458, 427/472, 562; 118/72, 629, 630, 638; 239/695, 239/696, 706, 708
See application file for complete search history.

(56) References Cited

U.S. PATENT DOCUMENTS

| | | | | |
|---|---|---|---|---|
| 4,748,043 | A * | 5/1988 | Seaver et al. | 427/482 |
| 5,273,854 | A * | 12/1993 | Shinozuka et al. | 430/114 |
| 5,824,462 | A * | 10/1998 | Ashida et al. | 430/531 |
| 6,110,590 | A * | 8/2000 | Zarkoob et al. | 428/364 |
| 6,200,666 | B1 * | 3/2001 | Christian et al. | 428/195.1 |
| 6,593,439 | B1 * | 7/2003 | Christian et al. | 526/246 |
| 6,860,956 | B2 * | 3/2005 | Bao et al. | 156/232 |
| 7,297,305 | B2 * | 11/2007 | Andrady et al. | 264/465 |
| 2001/0043260 | A1 * | 11/2001 | Gundlach et al. | 347/155 |
| 2004/0091633 | A1 * | 5/2004 | Wilson et al. | 427/532 |
| 2005/0104258 | A1 * | 5/2005 | Lennhoff | 264/465 |
| 2005/0224998 | A1 * | 10/2005 | Andrady et al. | 264/10 |
| 2005/0245651 | A1 * | 11/2005 | Cooper | 524/270 |
| 2006/0264130 | A1 * | 11/2006 | Karles et al. | 442/59 |
| 2007/0018361 | A1 * | 1/2007 | Xu | 264/465 |
| 2007/0141333 | A1 * | 6/2007 | Shastri et al. | 428/375 |

FOREIGN PATENT DOCUMENTS

| | | |
|---|---|---|
| CN | 1215420 A | 4/1999 |
| WO | WO 97/35929 | 10/1997 |

* cited by examiner

*Primary Examiner* — Michael Cleveland
*Assistant Examiner* — Xiao Zhao
(74) *Attorney, Agent, or Firm* — Patterson Thuente Christensen Pedersen, P.A.

(57) ABSTRACT

The invention relates to a method for priming a substrate by contacting the substrate with a primer fed from a primer source and depositing the primer on the substrate. Compared to other priming methods, the claimed priming gives better results because the deposition is carried out electrostatically.

28 Claims, 11 Drawing Sheets

Electrospinning apparatus

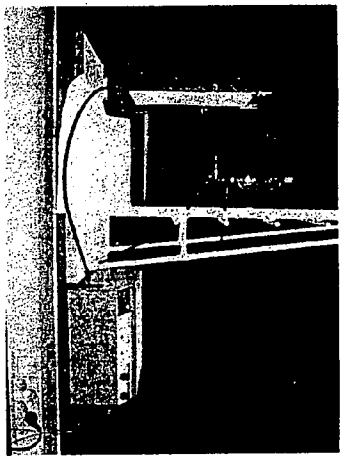
Figure 1: Electrospinning apparatus
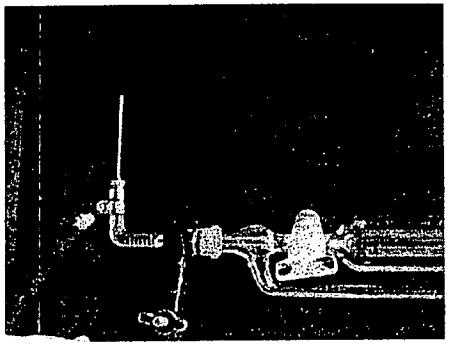
Figure 2: Feed section of electrospinnig apparatus
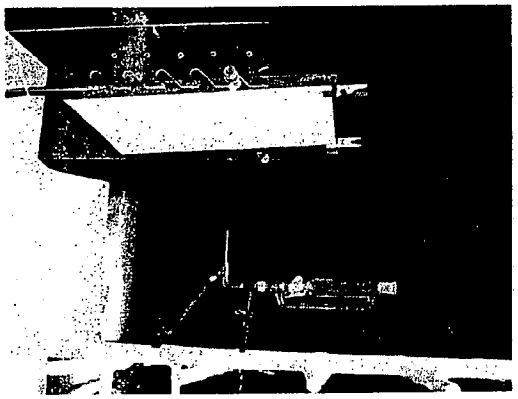
Figure 3: Feed section and the collector plate

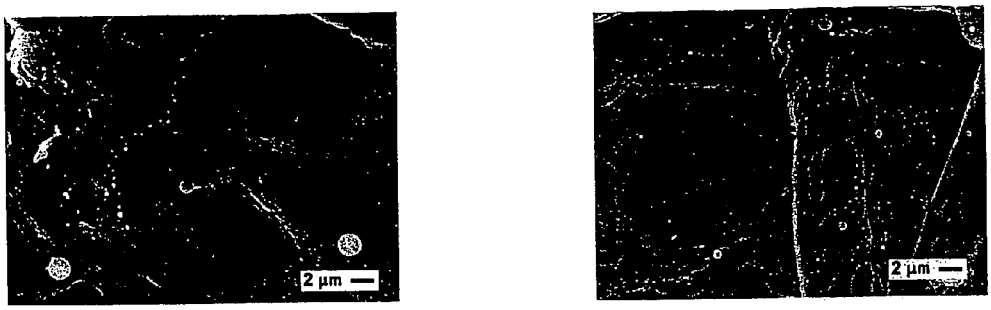
Figure 4: P1 with magnification 3500x, left: with coating weight 0,1 g/m$^2$, right: with coating weight 0,01 g/m$^2$
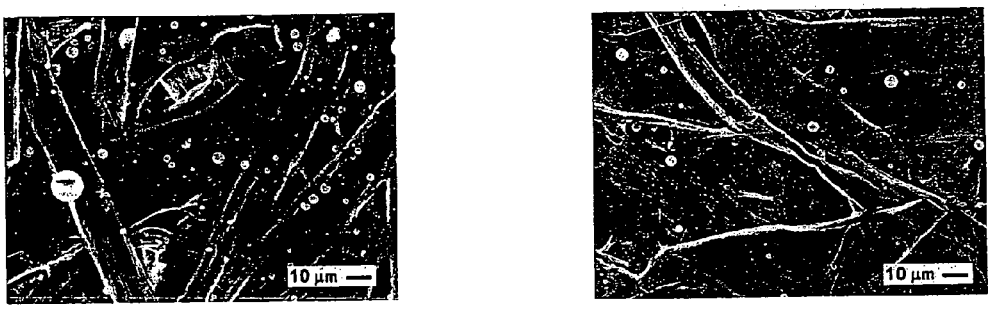
Figure 5: A SEM of P2 with a magnification of 750x, left: with coating weight 0,1 g/m2, right: with coating weight 0,01 g/m2
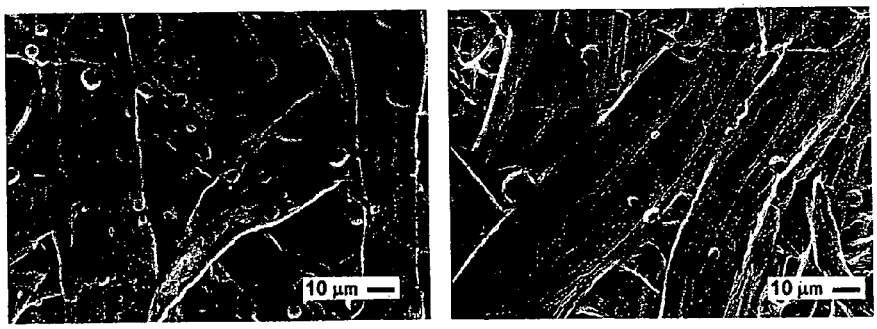
Figure 6: P3 with magnification 750x, left: with coating weight 0,1 g/m$^2$, right: with coating weight 0,01 g/m$^2$

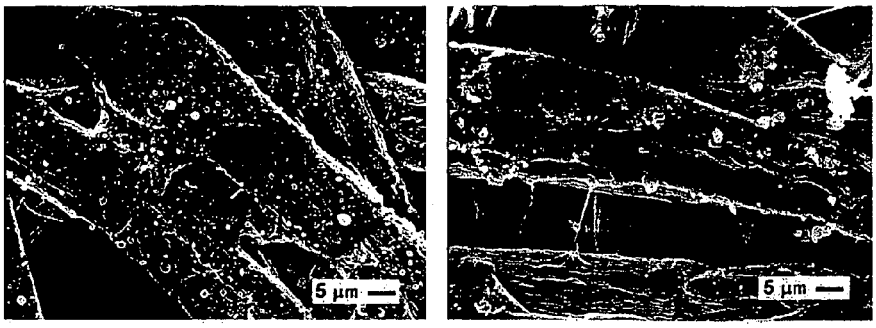
Figure 7: SEM of P5 with magnification 1500x, left: with coating weight 0,1 g/m$^2$, right: with coating weight 0,01 g/m$^2$
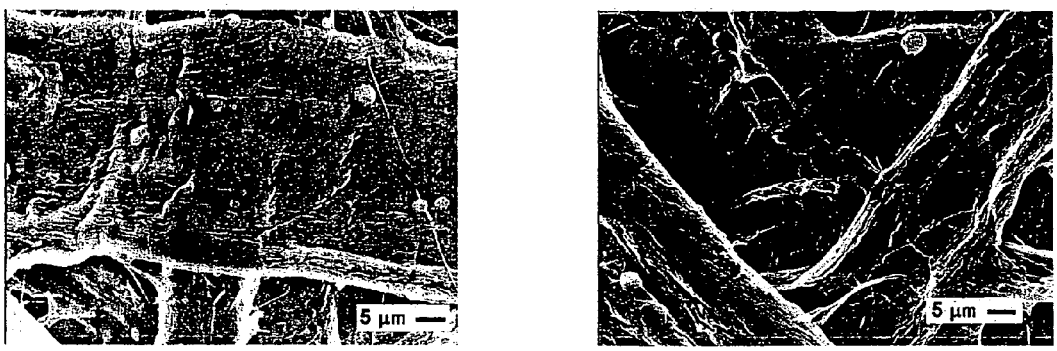
Figure 8: SEM of P6 with magnification 1500x, left: with coating weight 0,1 g/m$^2$, right: with coating weight 0,01 g/m$^2$
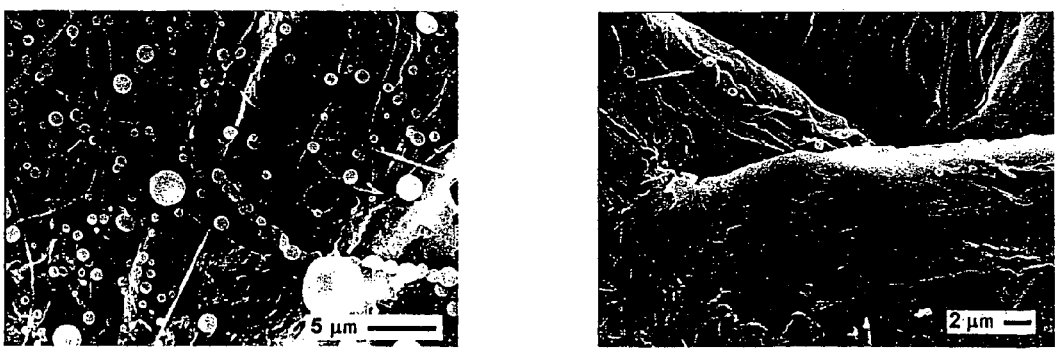
Figure 9: P7 with magnification 3500x, left: with coating weight 0,1 g/m$^2$, right: with coating weight 0,01 g/m$^2$

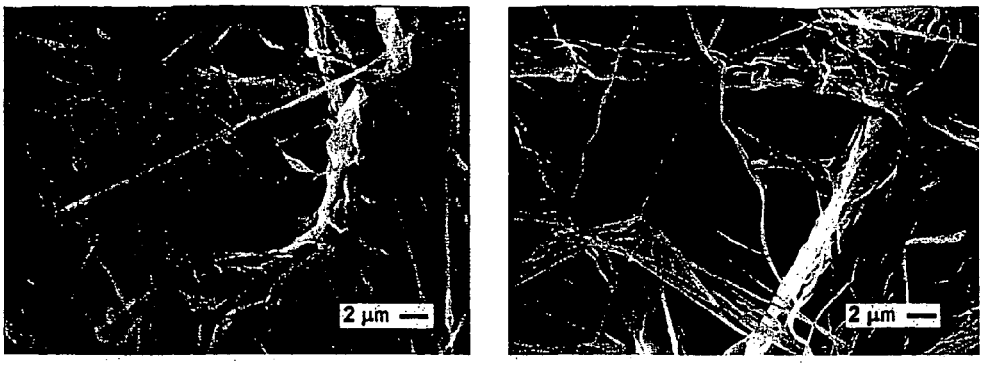
Figure 10: P11 with magnification 3500x, left: with coating weight 0,1 g/m$^2$, right: with coating weight 0,01 g/m$^2$
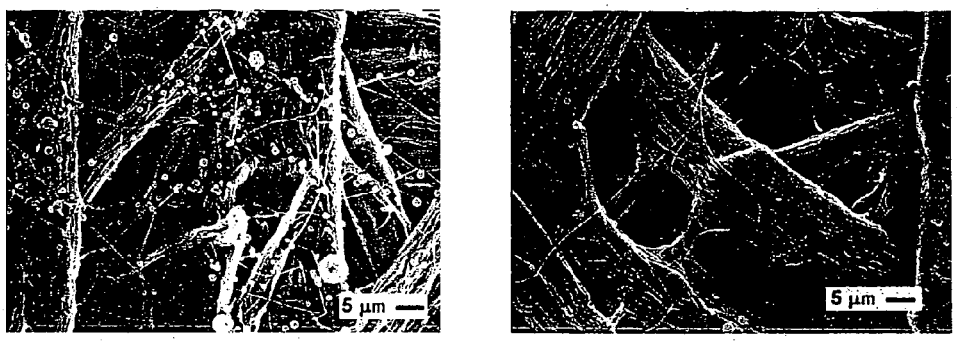
Figure 11: P12 with magnification 1500x, left: with coating weight 0,1 g/m$^2$, right: with coating weight 0,01 g/m$^2$
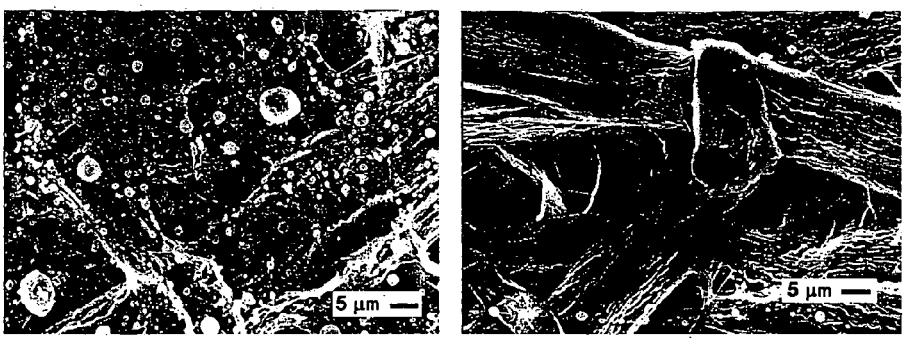
Figure 12: P13 with magnification 1500x, left: with coating weight 0,1 g/m$^2$, right: with coating weight 0,01 g/m$^2$

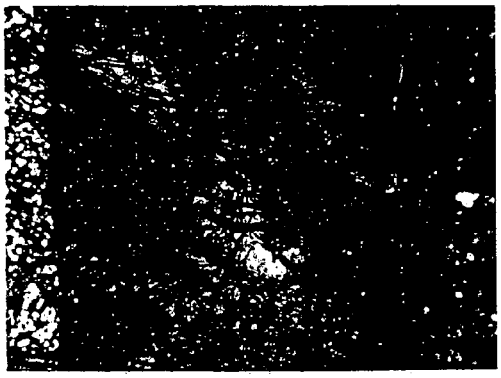
Figure 13: PE-film after peel test, P1-P13 with corona treatment.
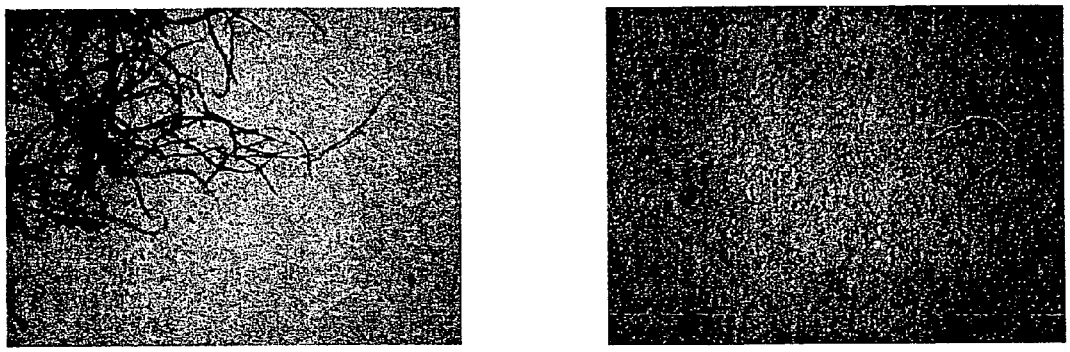
Figure 14: PE-film after peel test without corona treatment, P1-P13.
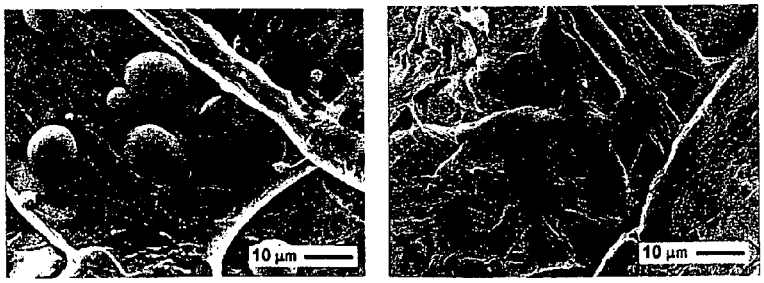
Figure 15: Paperboard with P3 after peel test. Left: without corona treatment and right: with corona treatment

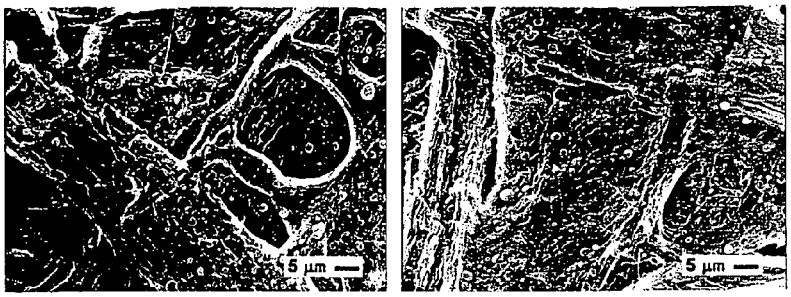
Figure 16: The paperboard with P5 after the peel test. At left without corona treatment and at right with corona treatment
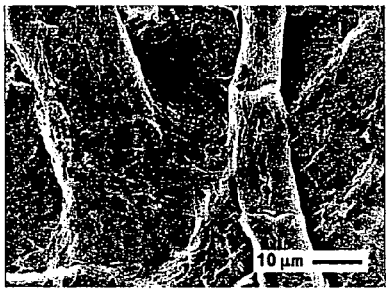
Figure 17: Paperboard with P6 after peel test and with corona treatment. Magnification 1500x.
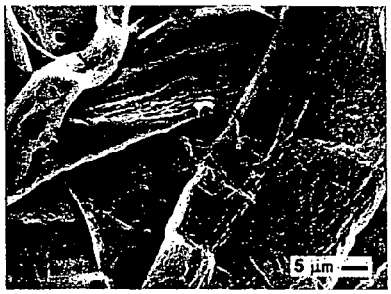
Figure 18: Paperboard with P7 after peel test and without corona treatment. Magnification 1500x.

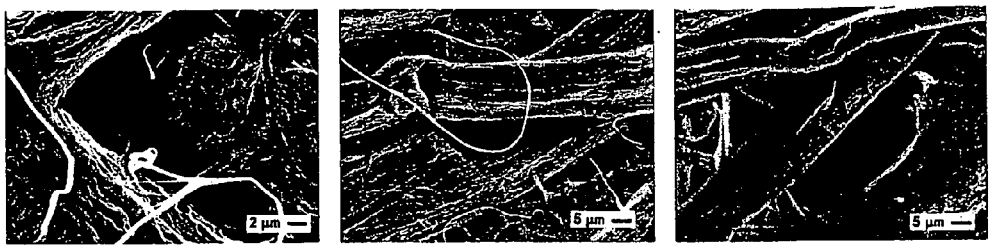
Figure 19: After peel test and without corona treatment; at left: paperboard with P11, magnification 3500x; in the middle: paperboard with P12, magnification 1500x; at right: paperboard with P13, magnification 1500x.

PRIMING AND COATING PROCESS

BACKGROUND OF THE INVENTION

The invention relates to a method for priming a substrate by contacting the substrate with a primer fed from a primer source and depositing the primer on the substrate. The invention also relates to a process for the coating of a substrate by contacting the substrate with a primer fed from a primer source, depositing the primer on the substrate, and coating the primed substrate with a coating substance.

There are several methods of improving the adhesion between a substrate and its coating. These methods can be surface treatment, mechanical roughening, removing weak boundary layers, minimising stresses, using adhesion promoters, using suitable acid-base interactions, as well as providing favourable thermodynamics and using wetting. Typical treatment techniques include the use of chemicals such as primers and solvents, the use of heat and flame, mechanical methods, plasma, corona treatment and radiation. Each technique can have several effects that improve adhesion.

An important method of improving the adhesion between a substrate and its coating is priming. Priming means the treatment of a substrate with a primer. A primer means a prefinishing coat applied to surfaces that are to be painted or otherwise finished. See McGraw-Hill Dictionary of Scientific and Technical Terms, $6^{th}$ Ed., p. 1668 and 1669.

Typical primers are adhesive organic substances which are soluble in water and/or an organic solvent and are used for treating the substrate surface in order to improve its adhesion or bonding to the coating. In the following table, typical primers and their adhesion and performance characteristics are given.

TABLE 1

Properties of typical primers

| | Adhesion Characteristics | | | Performance Characteristic | | |
|---|---|---|---|---|---|---|
| Type of primer | Paper | Metal | Plastic film | Heat Resistance | Moisture Resistance | Chemical Resistance |
| Shellac | Poor | Excellent | Poor | Poor | Poor | Poor |
| Organic Titanate | Good | Good | Good | Fair | Fair | Fair |
| Polyurethane | Very good | Excellent | Excellent | Excellent | Excellent | Excellent |
| Polyethyleneimine | Very good | Good | Excellent | Excellent | Poor | Poor |
| Ethylene Acrylic Acid | Excellent | Excellent | Fair | Fair | Excellent | Good |
| Polyvinylidene Chloride | Excellent | Fair | Excellent | Good | Very good | Fair |

Traditional priming takes place by conventional solution application techniques. The application of a primer promotes adhesion between the substrate and the coating by increasing the free energy (wettability) of the surfaces, inducing chemical reaction between them, and removing bond weakening impurities from them.

However, traditional priming has the drawback that it is difficult to achieve the correct coating weight suitable for the specific primer to be used. Uniform deposition is important for all primers. This is especially the case with uneven surfaces, the less available sites of which are poorly reached by conventional priming techniques.

SUMMARY OF THE INVENTION

These drawbacks have now been overcome by a new method for priming a substrate by contacting the substrate with a primer fed from a primer source and depositing the primer on the substrate. The claimed method is essentially characterized in that the deposition is carried out electrostatically. By deposition is meant the application of any material to a substrate. By electrostatically is meant something pertaining to electricity at rest, such as an electric charge on an object. See McGraw-Hill, Dictionary of Scientific and Technical Terms, 6.sup.th Ed., p. 707.

Electrostatic coating methods are known per se. However, the inventors found that these methods are especially suitable for priming purposes. By means of electrostatic coating, the correct coating weight suitable for any specific kind of primer can easily be achieved. Additionally, less available sites on uneven substrate surfaces are conveniently reached by the electrostatic priming techniques. Thus, a larger part of the substrate surface will possess improved primer-induced adhesion.

Electrostatic coating methods can be divided to three methods: electrostatic spraying and electrospinning, typically from solution under DC field, as well as dry coating from powders using AC fields.

In the spraying process, a high voltage electric field which is applied to the surface of a liquid causes the emission of fine charged droplets. The process is governed by mass, charge and momentum conservation. Therefore, there are several parameters, which influence the process. The most important parameters are the physical properties of the liquid, the flow rate of the liquid, the applied voltage, the used geometry of the system, and the dielectric strength of the ambient medium. The essential physical properties of the liquid are its electrical conductivity, surface tension and viscosity. An electrospray apparatus is typically formed of a capillary, pressure nozzle, rotating nozzle, or atomizer, which feed the coating liquid, and a plate collector which carries the substrate to be coated. An electrical potential difference is connected between the capillary and the plate.

The potential difference between the plate and the end of the capillary supplying the coating liquid is several thousands volts, typically dozens of kilovolts. The emitted droplets are charged and they may be neutralized if necessary by different methods. Their size varies, depending on the conditions used. The most suitable electrospraying conditions for priming are discussed in more detail below.

Electrospinning, just as electrospraying, uses a high-voltage electric field. Unlike electrospraying which forms solidified droplets, solid fibers are formed from a polymer melt or solution, which is delivered through a millimeter-scale nozzle. The resulting fibers are collected on a grounded or oppositely charged plate. With electrospinning, fibers can be produced from single polymers as well as polymer blends.

Electrospinning can be used to produce ultra-fine continuous fibers, the diameters of which range from nanometers to a few micrometers. The small diameter provides small pore size, high porosity and high surface area, and a high length to diameter ratio. The resulting products are usually in the non-woven fabric form. This small size and non-woven form makes electrospun fibers useful in variety of applications.

In a spinning process various parameters affect the resulting fibers obtained. These parameters can be categorized into three main types, which are solution, process and ambient parameters. Solution properties include concentration, viscosity, surface tension, conductivity, and molecular weight, molecular-weight distribution and architecture of the polymer. Process parameters are the electric field, the nozzle-to-collector distance, and the feed rate. Ambient properties include temperature, humidity and air velocity in the spinning chamber. The most suitable electrospinning conditions for priming are discussed in more detail below.

Dry coating is quite similar to the electrospraying and electrospinning processes, with the exception that the raw material is in powder form. One of the latest inventions is to coat paper with this method. Paper coating by dry coating method is an alternative method for the traditional pigment coating. This dry surface treatment (DST) of paper and paperboard combines the coating and calandering processes. In the DST process, the electrically charged powder particles are sprayed onto the surface of the paper or paperboard. The particles form a layer on the surface of the paper and attach to the paper by electrostatic forces. The final fixing which is made in a nip between heated rolls, provides adhesion and makes of the surface smooth.

In the following, the most important technical features of the invention are disclosed. The claimed process relates to the electrostatic priming of a substrate. Preferably the substrate to be primed is a solid material, such as wood, paper, textile, metal, plastic film, or a composite material. A preferred type of substrate is cellulose or wood containing <300 g/m$^2$ of non-coated or coated garde produced by means of normal wet paper processes. Most preferably, the solid material is paper. By paper is meant any felted or matted sheet containing as an essential part cellulose fibers.

The electrostatic deposition used in the claimed priming is according to one preferred embodiment electrospraying. In the electrospraying, the primer is preferably initially in the form of liquid droplets dispersed in the gas phase. The droplets may be either droplets of molten primer or, preferably, droplets of a solution of the primer material in a solvent. Typically, the average diameter of the liquid droplets is between 0.02 and 20 μm, preferably 0.05-2 μm.

According to another preferred embodiment of the invention, the claimed priming by electrostatic deposition is electrospinning. In the electrospinning, at least a part of the primer is in the form of fibers dispersed in the gas phase. The fibers may be formed either from molten primer or, preferably, droplets of a primer solution in a solvent. When forming the primer fibers by electrospinning, the average diameter of the fibers is preferably between 0.05 and 5.0 μm, most preferably between 0.1 and 0.5 μm.

The claimed electrostatic priming may also be a mixture of electrospraying and electrospinning, where both solid droplets and solid fibers are formed on the substrate.

When using electrostatic deposition (spraying, spinning, or both) from solution, the primer material content of the solution is preferably between 5 and 50% by weight, most preferably between 20 and 45% by weight. The solution is preferably between 40 and 400 cP, most preferably between 50 and 200 cP. The solvent is selected according to the primer applied, considering also that its volatility must be low enough for good productivity and its conductivity must be suitable for the electrostatic process. Preferred solvents are water and water/alcohol systems.

As was said above in connection with the general description of the invention, the primer material may be a native polymer, a polyalcohol, an organometal compound, and/or a synthetic polymer. Typically, the primer material is a synthetic polymer (homo- or copolymer). According to one advantageous embodiment of the claimed invention, the synthetic polymer is an acrylic copolymer, which most preferably is in the form of an aqueous emulsion. Then the deposited material thickness is typically 0.002-0.05 g/m$^2$, preferably 0.006-0.02, and most preferably about 0.01 g/m$^2$. According to another advantageous embodiment of the invention, the primer is diethanol aminoethane (DEAE), preferably in aqueous medium. Then, the preferred thickness of the deposited material is 0.02-0.5 g/m$^2$, more preferably 0.06-0.2, and most preferably about 0.1 g/m$^2$.

Most preferably, the primer solution also contains an additive to modify the morphology of the primer particles on the substrate. A preferred additive is a polymer soluble in the solvent and compatible with the primer, which has a sufficiently high molecular weight to stabilize the process. Preferably, the polymeric additive has to be suitable for the electrostatic process as well. Examples of polymers suitable as additives in the claimed electrostatic processes are among others polyvinyl alcohol, polyethylene oxide, and acrylic resins.

The electrostatic primering of the instant invention is preferably carried out by means of an apparatus suitable for either electrospraying or electrospinning. It consists of a fume chamber with minimised interference, in which a construction comprising a metal plate for supporting the substrate and a feed section are arranged. A voltage source is coupled to the metal plate and the feed section. The electrostatic force expressed as the voltage divided by the distance between the substrate and the primer source raised to the second power is according to one embodiment between 0.02 and 4.0 V/mm$^2$, preferably between 0.2 and 0.5 V/mm$^2$. The electrostatic voltage is preferably between 10 and 50 kV, more preferably between 20 and 40 kV, and the distance between the primer source and the substrate is preferably between 100 and 1000 mm, more preferably between 200 and 500 mm.

In addition to the above described method for priming a substrate electrostatically, the invention also relates to a process for coating a substrate by contacting the substrate with a primer fed from a primer source, depositing the primer on the substrate, and coating the primed substrate with a coating substance. Said deposition of the primer on the substrate is carried out electrostatically.

The claimed coating process thus comprises said electrostatic priming followed immediately or later by a coating process. For the priming step, the same specifications apply as above, so, there is no reason to repeat them here. However, when moving on from priming to coating, the primed substrate is preferably flame or, most preferably, corona treated before it is coated with the coating substance.

Typically, the coating substance is a thermoplastic resin. As the most advantageous substrate was paper, a preferred combination is the coating of paper with said thermoplastic resin. The best thermoplastic resin is a polyolefin resin such as an ethylene polymer (homo- or copolymer).

DESCRIPTION OF THE FIGURES

The Figures which will be referred to are:

FIG. 1 which shows an electrospinning apparatus according to one embodiment of the invention.

FIG. 2 which shows the feed section of the electrospinnig apparatus according to FIG. 1.

FIG. 3 which shows the seed section and the collector plate of the electrospinning apparatus according to FIG. 1.

FIG. 4 which shows a SEM of paper coated with P1 with a magnification of 3500×, left with the coating weight 0.1 g/m$^2$, right with the coating weight 0.01 g/m$^2$.

FIG. 5 which shows a SEM of paper coated with P2 with a magnification of 750×, left: with coating weight 0.1 g/m$^2$, right: with coating weight 0.01 g/m$^2$.

FIG. 6 which shows a SEM of paper coated with P3 with a magnification of 750×, left with the coating weight 0.1 g/m$^2$, right with the coating weight 0.01 g/m$^2$.

FIG. 7 which shows a SEM of paper coated with P5 with the magnification 1500×, left with the coating weight 0.1 g/m$^2$, right with the coating weight 0.01 g/m$^2$.

FIG. 8 shows a SEM of paper coated with P6 with the magnification 1500×, left with the coating weight 0.1 g/m$^2$, right with the coating weight 0.01 g/m$^2$.

FIG. 9 shows a SEM of paper coated with P7 with the magnification 3500×, left with the coating weight 0.1 g/m$^2$, right with the coating weight 0.01 g/m$^2$.

FIG. 10 shows a SEM of paper coated with P11 with the magnification 3500×, left with the coating weight 0.1 g/m$^2$, right with the coating weight 0.01 g/m$^2$.

FIG. 11 shows a SEM of paper coated with P12 with the magnification 1500×, left with the coating weight 0.1 g/m$^2$, right with the coating weight 0.01 g/m$^2$.

FIG. 12 shows a SEM of paper coated with P13 with the magnification 1500×, left with the coating weight 0.1 g/m$^2$, right with the coating weight 0.01 g/m$^2$.

FIG. 13 shows the PE-film coating after a peel test, P1-P13 with corona treatment.

FIG. 14 shows the paperboard with P3 after the peel test. Left without corona treatment and right with corona treatment.

FIG. 15 shows the paperboard with P5 after the peel test. At left without corona treatment and at right with corona treatment.

FIG. 16 shows the paperboard with P6 after the peel test and with corona treatment. The magnification was 1500×.

FIG. 17 shows the paperboard with P7 after the peel test and without corona treatment. The magnification was 1500×.

FIG. 18 shows SEM pictures after the peel test and without corona treatment; at left paperboard with P11, magnification 3500×; in the middle paperboard with P12, magnification 1500×; and at right paperboard with P13, magnification 1500×.

FIG. 19 shows the PE-film coating after the peel test without corona treatment, P1-P13.

DETAILED DESCRIPTION

Figure 20:
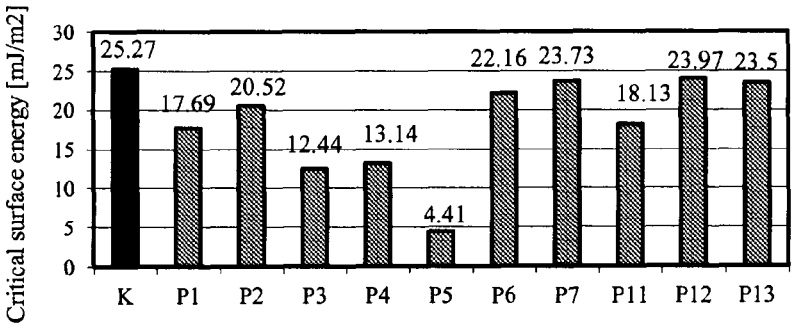
FIG. 20 shows the critical surface energies of primers (P1-P13) and paperboard (K).

In the following, the invention is exemplified by a few examples, the procedures of which are described more closely below.

In this experimental work, priming was made with an electrospinning apparatus as illustrated in FIG. 1. The apparatus includes a fume chamber, the walls of which, except the front side wall, are constructed of metal plate, to minimise the external and internal electrical interference. The inner wall surfaces are covered with glass fiber composite. The used power supply unit is a high-voltage supply of type BP 50 Simco. The power supply can produce both positive and negative 0-50 kV voltage.

The apparatus also includes a feed section having a spinneret and a needle. The needle is attached to the spinneret which is made of glass with luer (mikä on luer?) junction and the power supply is connected to the metallic junction of the needle. The feed section is illustrated in FIG. 2.

As a counter-electrode to the feed section a square copper plate is arranged, the size of which is 400 mm×400 mm×1 mm. This collector plate, which supports the substrate, is hung on a plastic stand. The collector plate and the feed section is illustrated in FIG. 3. To the front of the collector plate is attached the substrate to be coated. The substrate can be, for example, a metal folio, a paper, or a non-woven textile. In the experiments carried out, the substrate was paper of quality CTM ion-coated 225 g/m$^2$ wood free board of chemical pulp.

Suitable primers were selected by a preliminary test. Then, these primers, called P1-P13, were tested for solution viscosity (Brookfield DV-II+), morphology (JEOL SEM T-100), surface energy (PISARA-equipment), and adhesion (Alwetron peel test). The effect of a corona treatment of the primed paper substrate on the adhesion was also carried out.

13 primers, i.e. P1-P13, were tested. The symbols P1-P13 mean:

P1→Carboxyl methyl cellulose
P2→Alkyl ketene dimer
P3→Polyethylene amine
P4→Polyvinyl amine
P5→Polyvinyl alcohol
P6→Emulgated acrylic copolymer
P7→Ethylene copolymer
P11→Polyvinyl alcohol modified with ethylene groups
P12→Diethanol aminoethane (DEAE)
P13→MSA/$C_{20}$-$C_{24}$-olefin
B→$C_{20}$-$C_{24}$ olefin
C→ethylene copolymer
E→Polyvinyl amine
G→polyvinyl acetone
H→Dicthand aminoethene (DEAE)
I→carbonyl methyl cellulose The results were as follows.

Results and Discussion

The Primer's Suitablility to Electrospraying or -Spinning

The proper solution contents of primers and process parameters were found by experimentation. Several solution contents of each primer were tested. All primers were sprayed or spun through a 5 cm long needle, the size of which was 18 G.

Primers P5, P6 and P11 were especially suitable without using morphology modifying additives in the spraying/spinning solution. Primers P1, P2, P3, P7, P12, and P13 were also especially suitable, but they needed additives. Without additives they formed large droplets, and the coated areas were very small. With additives, coated area enlarged significantly and droplet size diminished.

The Productivity of the Electrospraying or -Spinning

The productivities for each primer are presented in Table 2. In the table are presented also other properties, which are used for calculating the rate of application, namely the specific weight of the solution, the primer content of the solution, and the primer consumption. Also the needed priming times for dry coating weights 0.1 g/m$^2$ and 0.01 g/m$^2$ are presented in the table.

TABLE 2

Productivities and other properties of each primer

| Primer | Specific Weight of the solution [g/ml] | Primer content of solution [%] | Consumption of solution [s/1 ml] | Area [m$^2$] | Productivity [g/m$^2$s] | Needed priming time For 0.01 g/m$^2$ | Needed priming time For 0.1 g/m$^2$ |
|---|---|---|---|---|---|---|---|
| P1 | 1.028 | 11.70 | 5040 | 0.0491 | 0.00049 | 21 s | 205 s |
| P2 | 0.915 | 31.67 | 6252 | 0.0491 | 0.00094 | 11 s | 106 s |
| P3 | 1.035 | 22.35 | 2768 | 0.0314 | 0.00266 | 4 s | 28 s |
| P5 | 0.973 | 15.00 | 3300 | 0.0491 | 0.00090 | 11 s | 111 s |
| P6 | 1.037 | 45.20 | 1410 | 0.0962 | 0.00346 | 3 s | 29 s |
| P7 | 1.041 | 22.33 | 2040 | 0.1200 | 0.00095 | 11 s | 107 s |
| P11 | 1.018 | 7.50 | 1800 | 0.0452 | 0.00094 | 11 s | 107 s |
| P12 | 0.982 | 25.00 | 1920 | 0.0855 | 0.00149 | 7 s | 67 s |
| P13 | 1.011 | 22.39 | 4562 | 0.0360 | 0.00138 | 7 s | 72 s |

During the consumption test, it was easy to see which ones of the primers are suitable for continuing priming and which ones are not, unless some changes are made to the solution or process. Primers P2, P3, P6, and P13 are not suitable for continuous priming, because they gel on the end of the needle. Instead, primers P1, P5, P7, P11, and P12 are suitable for continuous priming.

The needed priming times are only estimated. In productivity measurement, it was assumed that all of the primer is transferred from the needle to the collector plate. However, in practise some particles fly over the plate and some large droplets may not fly so far. During the consumption measurement, the process was at first faster and then became slower because the solution level and pressure in the needle were reduced with time. Thus the consumption values are average values. Coating areas are defined by eye, so these are also approximate values.

The Viscosity of the Primer Solutions and the Morphology of the Primed Paperboards The viscosities of the used primer solutions were the Brookfield viscosity. The morphologies of the deposited primer particles were measured by analysing SEM pictures. The SEM-pictures presented in this chapter, were taken randomly. In addition to the viscosity and the morphology, this chapter shows further process parameters such as the voltage and the working distance between the substrate and the feeding capillary.

In the following, each sample is treated separately.

Primer P1

The viscosity of the solution was 370 cP. Although the viscosity was high, primer P1 did not form fibers, but droplets. The droplet size was 0.1-0.3 μm, the voltage and working distance were ±35 kV and 350 mm, respectively, and the diameter of the coated area was 25 cm. A SEM of the layer of P1 is presented in FIG. 4.

Primer P2

The viscosity of the solution was 170 cP. Again, although the viscosity was sufficiently high, the primer did not form fibers, but droplets. The droplet size was 0.5-6 μM, the voltage and working distance were ±30 kV and 450 mm, respectively, and the diameter of the coated area was 25 cm. A SEM of the layer of P2 is presented in FIG. 5.

Primer P3

The viscosity of the solution was 215 cP. Also here, although the viscosity was sufficiently high, the primer formed droplets instead of fibers. The droplets were very large and also the size distribution was wide. The size of the droplets was 1,2-17 μm, the voltage and the working distance were ±50 kV and 350 mm, respectively, and the diameter of the coated area was 20 cm. A SEM of the layer of P3 is presented in FIG. 6.

Primer P5

Viscosity of solution was 193 cP. Again, although the viscosity was sufficiently high, primers did not form fibers, but droplets. Droplet size was 0.2-1.5 μm, voltage and working distance were ±40 kV and 400 mm, and diameter of coated area was 25 cm. Layer of P5 is presented in FIG. 7.

Primer P6

The viscosity of the solution was quite low: 90 cP, therefore it formed droplets. The droplet size was 0.2-5 μm, the voltage and working distance were ±30 kV and 300 mm, respectively, and the diameter of the coated area was 35 cm. Layer of P6 is see in FIG. 8.

Primer P7

The viscosity of the solution was 60 cP. Although the viscosity was low, the primer formed also fibers besides droplets. The fiber forming is probably caused by use of additives. The fiber diameter was approximately 0.1 μm and the droplet size was 0.5-6 μm, and the voltage and working distance were ±30 kV and 400 mm, respectively. The primer coated area was very large. The primer coated the whole area of the collector plate. Layer of P7 is presented in FIG. 9.

Primer P11

Thy viscosity of the solution was 110 cP. Primer 11 formed only thin fibers, including some pearls. The fibre diameter was 0.4-0.1 μm and the pearl size was 0.8-1.4 μM. The voltage and working distance were ±40 kV and 400 mm, respectively, and the diameter of the coated area was 24 cm. The layer of P11 is presented in FIG. 11.

Primer P12

The viscosity of the solution was 60 cP. Although the viscosity was low, the primer formed also fibers besides droplets. The fiber formation is probably caused by the use of additives. The droplet size was 0.5-3 μm and the fibre diameter was 0.1-0.4 μm. The voltage and working distance were ±20 kV and 300 mm, respectively, and the direction of the electric field was from minus potential to plus potential. The diameter of the coated area was 33 cm. Layer of P12 is presented in FIG. 12.

Primer P13

The viscosity of the solution was 310 cP. Although the viscosity was sufficiently high, the primer formed droplets instead of fibers. The droplet size was 0.2-2.5 μm, the voltage and working distance were ±30 kV and 250 mm, respectively, and the diameter of the coated area was 18 cm. A layer of P13 is presented in FIG. 13.

The Surface Energy

The critical surface energies of the primers are presented in FIG. 20. Their surface energies are compared to the surface energy of the paperboard. Surface energy values of all primers are smaller than surface energy of the paperboard. In FIG. 20 sample K means paperboard and P1-P13 primers, which was used in preliminary tests.

Figure 21:
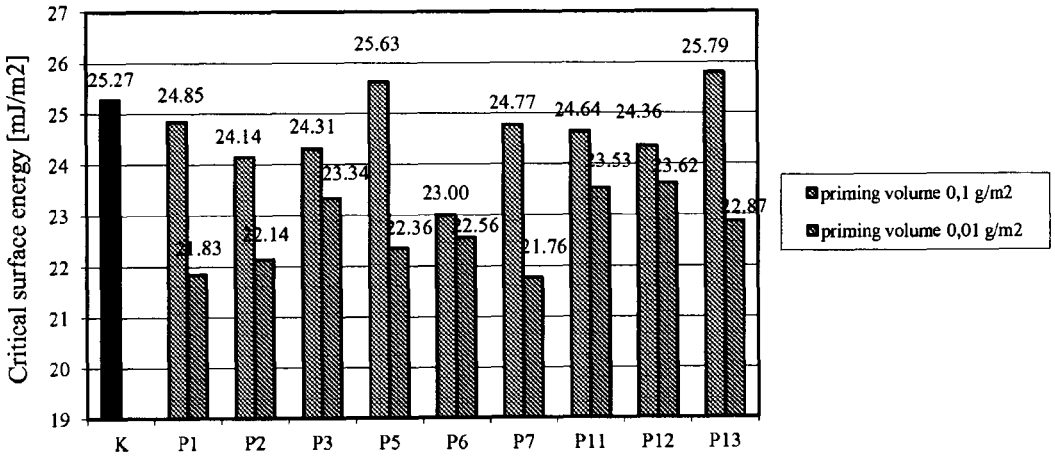
FIG. 21 shows the critical surface energies of primed paperboard.

The critical surface energies of primed paperboard are presented in FIG. 21. The critical surface energy values of the primed paperboard are smaller than the surface energy value of the paperboard itself. The surface energy values by geometric mean are presented in Appendix 1.

The surface energy determination was done with three liquids, which is the minimum count.

Adhesion of Primers and Priming Methods

The adhesion was measured by priming paper conventionally (primers B-I) and according to the invention (primers P1-P13), extrusion coating with LDPE, and finally measuring the adhesion force between the LDPE and the paper. The primers B-I which were primed to the paperboard by conventional spreading, are chemically similar to primers P1-P13, respectively. When priming by spreading, the obtained priming weight is higher compared to the electrostatic method (>>0.1 g/m$^2$).

Figure 22:
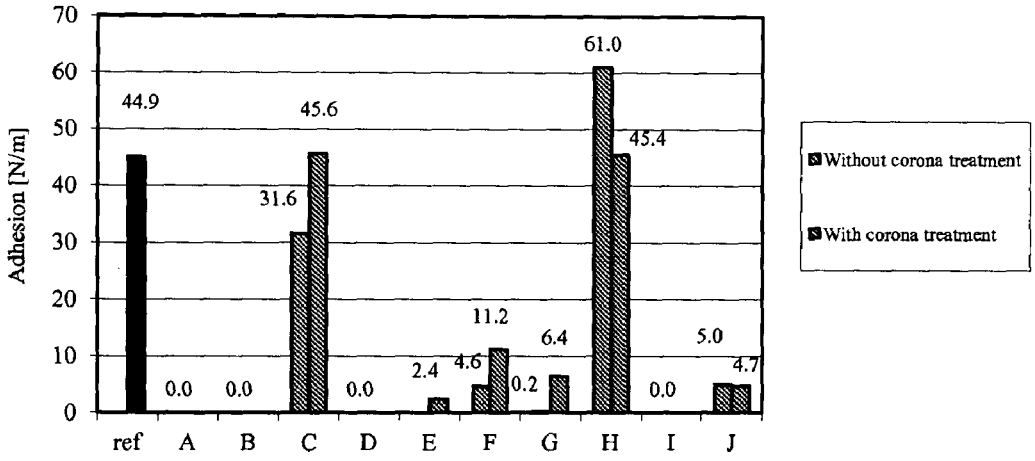
FIG. 22 shows adhesion measurement results.

Adhesion measurement results of primers B-I primed by spreading are presented in FIG. 22. Primers B-I applied by spreading do not significantly improve adhesion. Only primer H improves adhesion, if extrusion coating is made without corona treatment.

Figure 23:
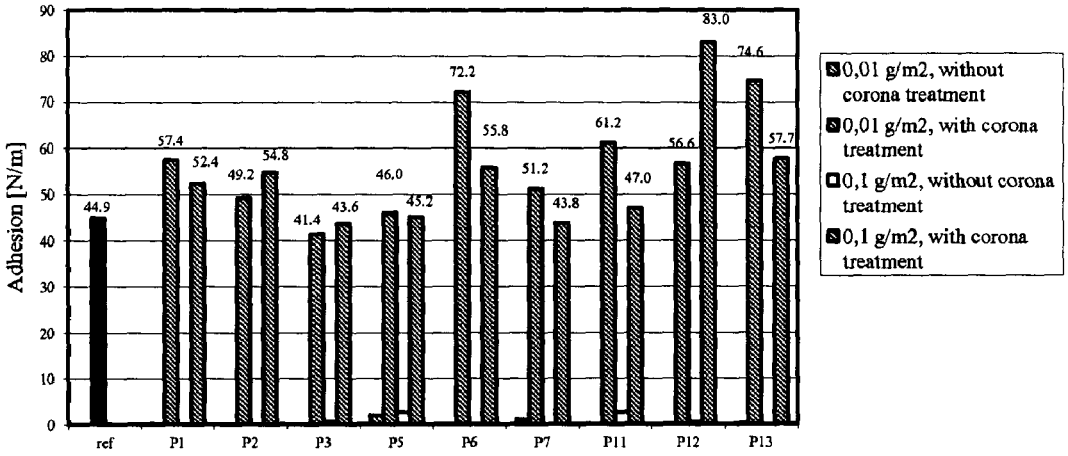
FIG. 23 shows the adhesion with primers (P1-P13).

In FIG. 23 is presented the adhesion of samples, whose priming weights are 0.1 g/m$^2$ and 0.01 g/m$^2$. Priming is done with the electrostatic coating method. Primers P1-P13 need corona treatment for improving adhesion. When corona treatment is not used, the adhesion is zero with almost every primer. Primers P1, P6, P11, and P13 especially with coating weight 0.01 g/m$^2$, and P12 especially with coating weight 0.1 g/m$^2$ improve the adhesion significantly. Also primer P7 with coating weight 0.01 g/m$^2$ and primer P2 with coating weight 0.1 g/m$^2$ are good adhesion promoters.

The reference in both FIGS. 22 and 23 is PE coated paperboard with corona treatment, and without the use of primer.

Each primer has a unique coating weight, which gives a maximal adhesion.

The primers were attached to the paperboard and the PE-film, when corona treatment was used with the extrusion coating. This fact is illustrated in FIG. 14. The picture is taken after peel test on an iodine dyed surface of the PE-film. Only primers P3 and P6 with priming weight 0.1 g/m$^2$ have attached to the PE-film only partly.

When corona treatment is not used in extrusion coating, primers do not promote adhesion, because they do not attach to the PE-film. FIG. 15 shows the PE-film after the peel test. Some of the chemical pulp is attached to the surface of the PE, but mainly it is not attached to the PE without corona treatment.

In the following figures SEM-pictures after the peel test are presented. These SEM-pictures have been taken from the paperboard side. Thus, the pictures show the morphology changes after extrusion coating, when they are compared to the SEM-pictures, which have been taken just after the priming.

The morphology of P3 does not change if corona treatment was not used with extrusion coating. When corona treatment was used, the primer was spread on the surface of the paperboard. In FIG. 16, the picture to the right has been taken at a point, which is not attached to the PE-film. The points where the paperboard primed with P3 is attached to the PE-film looks like the FIG. 14.

The paperboard with primer P5 has also been attached partly to the PE-film. The picture to the right in FIG. 17 was taken at a point, where the paperboard is not attached to the PE. The morphology of the primer P5 does not significantly change during extrusion coating despite the use of corona treatment.

The morphology of primed P6 changed during extrusion coating if corona treatment was used. P6 spreads on the surface of the paperboard. FIG. 18 has been taken at a point, where there is no attachment to the PE. Probably the priming weight 0.1 g/m$^2$ is too much, because the paperboard with P6 is not attached properly to PE.

The morphology of P7 changes in extrusion coating significantly. The fiber is attached to the surface of the paperboard, spreads a bit, and probably absorbed (FIG. 19). Instead the morphology of P8 is not significantly changed in extrusion coating (FIG. 20).

The morphology of P11, P12, and P13 has changed significantly during the extrusion process (FIG. 21). All of these primers are attached to the surface of the paperboard, primers have spread and probably absorbed to the surface of the paperboard.

Morphology changes during extrusion process depend on primers. Only connecting issue with primers, which is proved already in peel tests, is that corona treatment in extrusion process improves adhesion significantly.

CONCLUSIONS

This work proves that electrostatic coating methods are suitable for priming.

Improvement in adhesion is achieved compared to conventional priming by spreading. Lower priming weights give even better adhesion than higher priming weights. However, primers should preferably be corona treated in extrusion coating when coating paper with polyethylene. Adhesion results shows that every primer have a specific priming weight, which gives a maximal adhesion.

Figure 24:
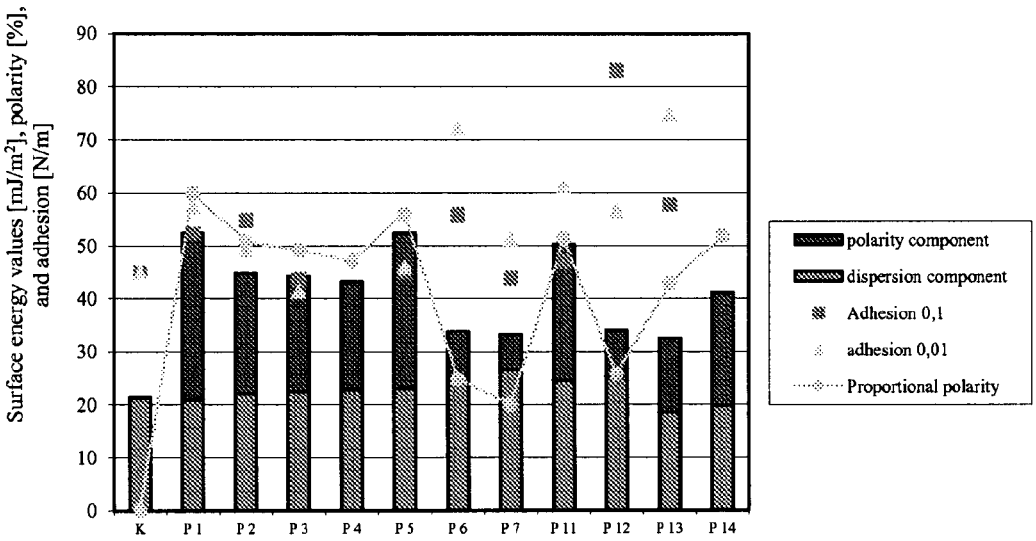
FIG. 24 shows surface energy values (geometric mean) and adhesion of primers.
Figure 25:
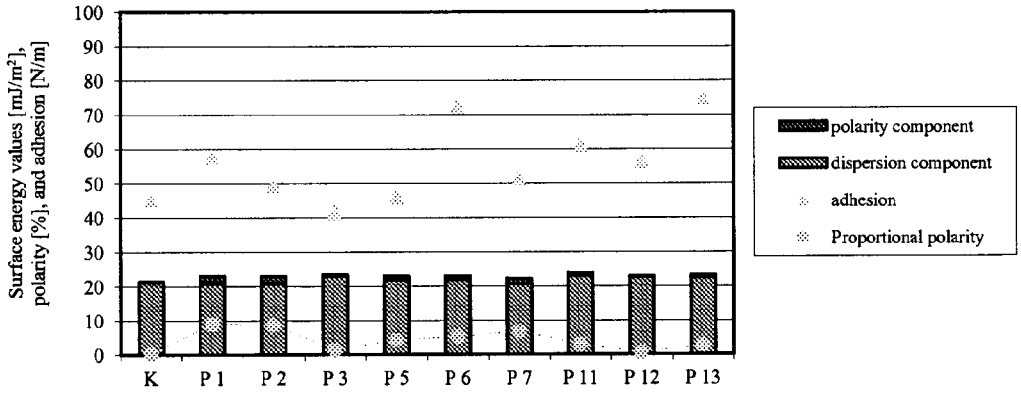
FIG. 25 shows surface energy (geometric mean) and adhesion, where the priming weight was 0.01 g/m$^2$.
Figure 26:
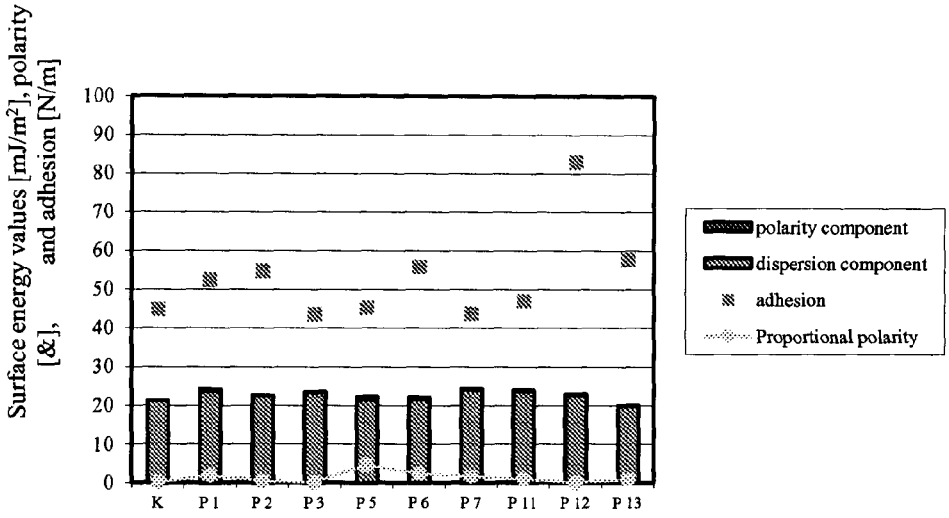
FIG. 26 shows surface energy (geometric mean) and adhesion, where the priming weight was 0.1 g/m$^2$.

The correlation between the surface energy values and the adhesion is presented in FIGS. 24-26. From these figures can be seen that low polarity improves adhesion.

Figure 27:
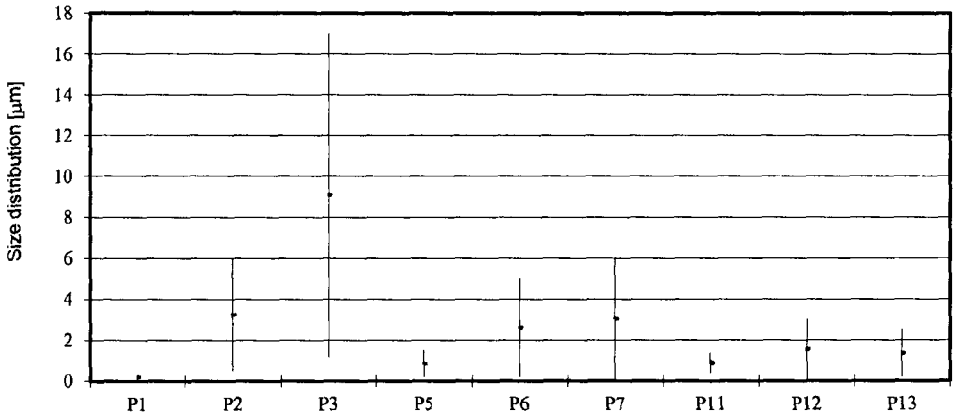
FIG. 27 shows the particle size distribution of primer layers.

In FIG. 27 is presented the particle size distribution of each primer layer. On the basis of the above, particle sizes affects adhesion. Thus, primer P12 has excellent adhesion properties, because it has a low proportional polarity and small particle size. Probably the effect of particle size is based on the fact that smaller particles form more adhesive spots per area onto the surface of the paperboard.

In addition to primer polarity and particle size, adhesion properties change also with different priming weights. Some primers improve adhesion better with priming weight 0.01 g/m$^2$ than with priming weight 0.1 g/m$^2$, and others improve adhesion better with priming weight 0.1 g/m$^2$.

APPENDIX 1

Surface energy values by geometric mean of paperboard, primers P1-P14, and primed paperboards

| | Dispersion component [mJ/m$^2$] | Polarity component [mJ/m$^2$] | Proportional polarity | Surface energy [mJ/m$^2$] |
|---|---|---|---|---|
| Paperboard | 21.26 | 0.02 | 0.001 | 21.28 |
| P1 | 20.96 | 31.41 | 0.600 | 52.37 |
| P2 | 22.03 | 22.72 | 0.508 | 44.75 |
| P3 | 22.49 | 21.73 | 0.491 | 44.22 |
| P4 | 22.8 | 20.35 | 0.472 | 43.14 |
| P5 | 22.99 | 29.35 | 0.561 | 52.34 |
| P6 | 25.37 | 8.36 | 0.248 | 33.73 |
| P7 | 26.56 | 6.65 | 0.200 | 33.21 |
| P8 | 28.27 | 8.64 | 0.234 | 36.92 |
| P9 | 23.27 | 21.78 | 0.483 | 45.05 |
| P10 | 24.39 | 9.38 | 0.278 | 33.77 |
| P11 | 24.52 | 25.75 | 0.512 | 50.27 |
| P12 | 25.27 | 8.74 | 0.257 | 34.01 |
| P13 | 18.53 | 13.87 | 0.428 | 32.4 |
| P14 | 19.81 | 21.35 | 0.519 | 41.16 |
| | | Primed 0.01 g/m$^2$ | | |
| P1 | 21 | 2.08 | 0.090 | 23.08 |
| P2 | 20.96 | 1.97 | 0.086 | 22.93 |
| P3 | 23.17 | 0.33 | 0.014 | 23.49 |
| P5 | 22 | 0.96 | 0.042 | 22.96 |
| P6 | 21.84 | 1.19 | 0.052 | 23.03 |
| P7 | 20.78 | 1.5 | 0.067 | 22.27 |
| P11 | 23.14 | 0.69 | 0.029 | 23.83 |
| P12 | 22.83 | 0.09 | 0.004 | 22.93 |
| P13 | 22.64 | 0.61 | 0.026 | 23.25 |
| | | Primed 0.1 g/m$^2$ | | |
| P1 | 23.75 | 0.45 | 0.019 | 24.2 |
| P2 | 22.62 | 0.1 | 0.004 | 22.73 |
| P3 | 23.45 | 0.02 | 0.001 | 23.47 |
| P5 | 21.37 | 1.02 | 0.046 | 22.39 |
| P6 | 21.66 | 0.5 | 0.023 | 22.17 |
| P7 | 23.99 | 0.39 | 0.016 | 24.38 |
| P8 | 21.34 | 1.71 | 0.074 | 23.06 |
| P11 | 23.71 | 0.23 | 0.010 | 23.94 |
| P12 | 22.89 | 0 | 0.000 | 22.9 |
| P13 | 19.92 | 0.17 | 0.008 | 20.09 |

The invention claimed is:

1. A method for treating the surface of a paper comprising:

feeding a primer from a primer source;

uniformly depositing the primer on the paper, the primer having a coating weight up to 0.5 g/m$^2$, wherein the deposition is carried out electrostatically with electrospinning;

flame or corona treating the primed paper, the depositing and treating steps providing the primed paper with a prefinished surface; and coating the prefinished surface with a thermoplastic resin.

2. The method of claim 1, wherein the electrostatic deposition further comprises electrospraying and wherein the primer being deposited by electrospraying is in the form of liquid droplets dispersed in a gas phase.

3. The method of claim 2, wherein the liquid droplets are formed from a solution or emulsion of the primer in a solvent medium or emulsion medium, respectively.

4. The method of claim 3, wherein the liquid droplets are formed from a solution of the primer in a solvent medium and wherein a primer content of the solution is between about 20 and 45% by weight.

5. The method of claim 3, wherein a viscosity of the solution is between about 40 and 400 cP.

6. The method of claim 3, wherein the solvent includes an aqueous solvent system.

7. The method of claim 6, wherein the solvent is water or a mixture containing water and an alcohol.

8. The method of claim 1, wherein the primer having a coating weight up to 0.1 g/m$^2$.

9. The method of claim 1, wherein at least a part of the primer deposited by electrospinning is in the form of fibers dispersed in a gas phase.

10. The method of claim 9, wherein the fibers are formed from a solution or an emulsion of the primer material in a solvent medium or emulsion medium, respectively.

11. The method of claim 9, wherein an average diameter of the fibers is between about 0.1 and 0.5 μm.

12. The method of claim 1, wherein the primer is selected from the group consisting of native polymers, polyalcohols, organometal compounds, and synthetic polymers.

13. The method of claim 1, wherein the primer is a synthetic polymer.

14. The method of claim 13, wherein the synthetic polymer is an acrylic copolymer which is emulgated in an aqueous emulsion medium.

15. The method of claim 14, wherein said acrylic polymer is deposited on the surface of the paper in the amount of between about 0.002-0.05 g/m$^2$.

16. The method of claim 1, wherein the primer is diethanol aminoethane (DEAE).

17. The method of claim 16, wherein the diethanol aminoethane (DEAE) is deposited on the paper to a thickness of about 0.02-0.5 g/m$^2$.

18. The method of claim 1, wherein the primer is deposited on the paper as primer particles and wherein the primer contains an additive to modify the morphology of the primer particles on the paper.

19. The method of claim 18, wherein the additive is a soluble polyethylene oxide polymer.

20. The method of claim 1, said method generating an electrostatic force expressed as the voltage divided by the distance between the paper and the primer source raised to the second power of between about 0.02 and 4.0 V/mm$^2$.

21. The method of claim 20, wherein the electrostatic voltage is between about 10 and 50 kV.

22. The method of claim 20, wherein the electrostatic voltage is between about 20 and 40 kV, and the distance between the primer source and the paper is between about 100 and 1000 mm.

23. The method of claim 22, wherein the distance between the primer source and the paper is between about 200 and 500 mm.

24. The method of claim 23, wherein the electrostatic voltage divided by the distance between the primer source and the substrate is between about 1 and 4 kV/cm.

25. The method of claim 1, said method generating an electrostatic force expressed as the voltage divided by the distance between the paper and the primer source raised to the second power of between about 0.2 and 0.5 V/mm$^2$.

26. The process of claim 1, wherein the thermoplastic resin is a polyolefin.

27. The process of claim 26, wherein the polyolefin is an ethylene homopolymer or an ethylene copolymer.

28. A method for treating the surface of a paper comprising:

feeding a primer from a primer source;

uniformly depositing the primer on the paper, the primer having a primer coating weight up to 0.5 $g/m^2$, wherein the deposition is carried out electrostatically with electrospinning and provides a primed paper with a prefinished surface; and coating the prefinished surface with a thermoplastic resin.

* * * * *